US006550537B1

(12) United States Patent
Alvarez et al.

(10) Patent No.: US 6,550,537 B1
(45) Date of Patent: Apr. 22, 2003

(54) TENSION LATCHING SYSTEM

(75) Inventors: Ralph A. Alvarez, Houston, TX (US); Michael J. Miller, Katy, TX (US)

(73) Assignee: Kugerner Oilfield Products, Inc., Houston, TX (US)

( * ) Notice: Subject to any disclaimer, the term of this patent is extended or adjusted under 35 U.S.C. 154(b) by 0 days.

(21) Appl. No.: 10/042,551

(22) Filed: Jan. 9, 2002

Related U.S. Application Data

(60) Provisional application No. 60/275,860, filed on Mar. 14, 2001.

(51) Int. Cl.[7] ..... E21B 29/12; F16L 35/00

(52) U.S. Cl. ..... 166/348; 166/365; 166/345; 166/347; 285/18

(58) Field of Search ..... 166/348, 366, 166/349, 345, 359, 368, 347; 405/224; 285/10, 920, 101

(56) References Cited

U.S. PATENT DOCUMENTS 3,421,580 A * 1/1969 Fowler et al.
3,545,847 A * 12/1970 Haeber
3,583,480 A * 6/1971 Regan ..... 166/352
3,678,996 A * 7/1972 Herd ..... 166/368
3,693,714 A * 9/1972 Baugh ..... 166/348
3,933,202 A * 1/1976 Ahlstone ..... 166/182
4,298,067 A * 11/1981 Lawson ..... 166/341
4,422,507 A * 12/1983 Reimert ..... 166/348
4,433,859 A * 2/1984 Driver et al. ..... 285/315
4,456,070 A * 6/1984 Watkins ..... 166/344
4,477,104 A * 10/1984 Akkerman ..... 166/124
4,597,448 A * 7/1986 Baugh ..... 166/125
4,751,986 A * 6/1988 Takahashi ..... 188/67
4,856,594 A * 8/1989 Jennings ..... 166/338
4,989,359 A * 2/1991 Kinkner et al. ..... 42/77
5,168,933 A * 12/1992 Pritchard et al. ..... 166/212

* cited by examiner

*Primary Examiner*—Thomas B. Will
*Assistant Examiner*—Thomas A. Beach
(74) *Attorney, Agent, or Firm*—Wendy Buskop; Buskop Law Group, P.C.

(57) ABSTRACT

A subsea wellhead with a tension latching system for a casing hanger or a tubing hanger, a tension latching system for hangers, and a method for adjusting the tension on a casing hanger or tubing hanger for subsea wells.

19 Claims, 4 Drawing Sheets

TENSION LATCHING SYSTEM

The present invention claims priority to Provisional Patent Application Ser. No. 60/275,860 filed in the U.S. Patent and Trademark Office on Mar. 14, 2001.

BACKGROUND OF THE INVENTION

This invention relates to a tubing hanger for a subsea wellhead installed on the ocean floor. A need has long existed for an adjustable tubing hanger, adjustable between 6 and 10 feet, to set tension on the tie back. This invention relates to a tubing hanger, which is adjustable, so that the end of the tubing hanger does not need to be cut during the installation process to fit the needed dimensions of the wellhead. The resulting system is a tension latching system which can be used on an offshore platform, such as a Spar, or a deep draft cassion vessel, a tension leg platform, (TLP), a compliant tower production rig or a jack up production rig.

During the completion of an offshore well, the tubing hangers are typically lowered into supported positions within the wellhead housing through a blowout preventer (BOP) stack installed above the housing. Often the fit is not exact, and the bottom portions of the tubing hangers need to be cut in order to provide a proper fit in the annulus of the wellhead housing.

An object of this invention is to provide an adjustable tubing hanger to eliminate of the tubing hanger components, to minimize the possibility of leakage due to inaccurate cuttings and uneven sealing surfaces.

An object of the invention is to provide a safer, and faster means of installing tubing hangers with significant environmental advantages, and lower construction costs.

SUMMARY OF THE INVENTION

The invention is for a wellhead using a tension latching system and a tension latching system, and a method for using a tension latching system. The tension latching system comprises a hanger, such as a casing hanger or a tubing hanger, having an inner barrel and a housing assembly for an inner barrel, and comprises a latching segment contained within the inner barrel, wherein the latching segment further comprises a profile with a first side for engaging the inner barrel with latching teeth and a second side abutting the housing of the inner barrel; an adjustable inner barrel connecting to the latching segment, having an inner surface and an outer surface, and further comprising inner barrel teeth disposed on the outer surface and the latching teeth engaging the inner barrel teeth in an interlocking engagement; at least one spring for energizing the latching segment against the adjustable inner barrel; a locking mechanism comprising a pin and a spring to orient the latching segment in the housing assembly of the inner barrel; a running tool having a tension adjusting feature which enables the inner barrel to be adjusted to tolerances within ½ inch which further consists of a pack off assembly with pack off seals adapted to ratchet the latching segment until the correct tension is achieved on the adjustable inner barrel.

The invention also relates to a method for latching a casing hanger for a subsea wellhead having an inner barrel and a housing assembly for an inner barrel, comprising the steps of: assembling a running tool with a pack off assembly on the running tool, wherein the pack off assembly has a split ring latching mechanism and a locking mechanism comprising a pin and a spring; stabbing into the inner barrel engaging the split ring latching mechanism, locking the pack off assembly to the inner barrel; pulling up on the running tool, forming tension on the running tool; adjusting the tension on the inner barrel to a predetermined amount of tension by ratching the latching segments against the inner barrel until the latching segment fixedly engages and locks the inner barrel in place; and removing the running tool from the pack off assembly.

DETAILED DESCRIPTION OF THE PREFERRED EMBODIMENTS

Figure 1:
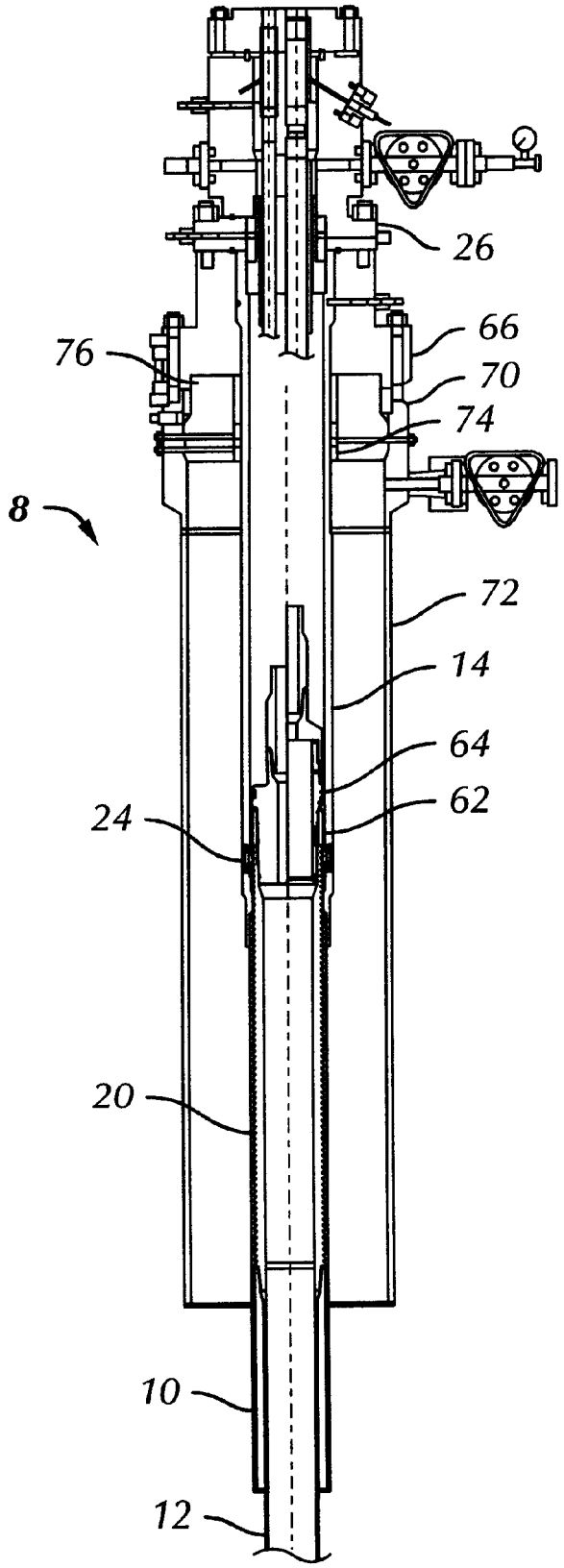
FIG. 1 is a cross section view of a wellhead with the latching system installed.
Figure 2:
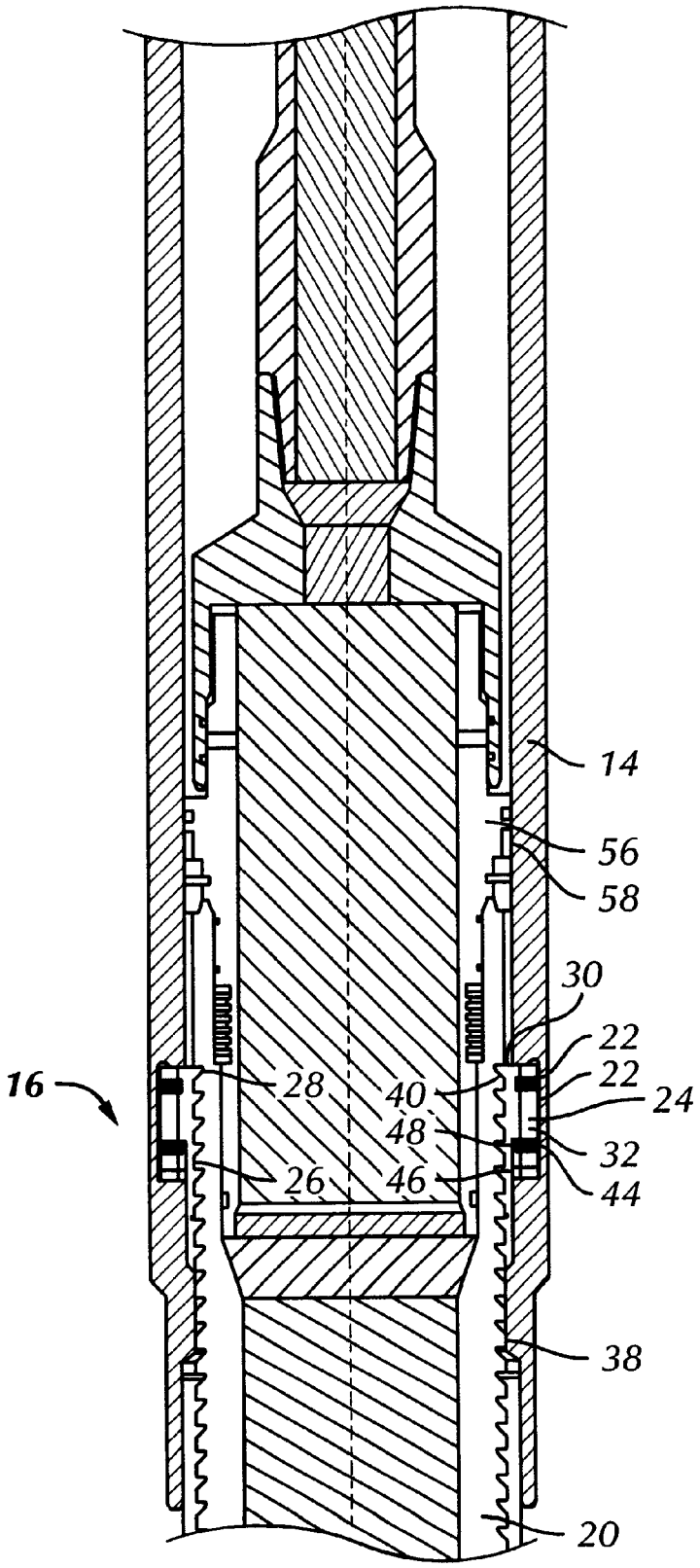
FIG. 2 is a shows and embodiment of the latching system for the wellhead using a pack off.

In its preferred and illustrated embodiment, as shown in FIGS. 1 and 2, a wellhead 8, such as a subsea wellhead, has a casing 10. Casing 10 is connected to a well by coupler 12. Casing 10 is a part of the casing hanger housing 14. The novel tension latching system 16 for the wellhead applies to a casing hanger or a tubing hanger (not shown), but preferably a casing hanger housing 14 having an adjustable inner barrel 20 and a housing assembly for a housing 22.

As shown in FIG. 2, the tension latching system 16 has a latching segment 24 contained within the casing hanger housing 14. The latching segment 24 further comprises a profile 26 used to retain the latching segment 24 within the housing 22 of the casing hanger housing 14. The profile 26 has a first side 28 for engaging the adjustable inner barrel 20. The profile 26 abuts against the housing 22 of the adjustable inner barrel 20. This first side 28 preferably has latching teeth 30. The profile 26 also has a second side 32, which in the most preferred embodiment, abuts against the housing 22 of the adjustable inner barrel 20.

An adjustable inner barrel 20 is connected to the latching segment 24. This adjustable inner barrel 20 has an inner surface 36 and an outer surface 38. Inner barrel teeth 40 are disposed on the outer surface 38. These inner barrel teeth 40 engage with the latching teeth 30 in an interlocking engagement. This engagement permits the adjustable inner barrel 20 to be easily moved and aligned with the latching segment 24 for increased safety to the required tension pull.

A first spring 42 is contemplated as usable for energizing the latching segment 24 against the adjustable inner barrel 20. More than one spring can be used and two are shown as first spring 42 and second spring 44 in FIG. 2. In an alternative embodiment, it is contemplated that two springs are usable, wherein the springs are either the same size, or one spring is a small spring and the second spring is a large spring. The invention contemplates that the "spring" force must be enough so that the latching segment engages the adjustable inner barrel for adjustment purposes.

Figure 3:
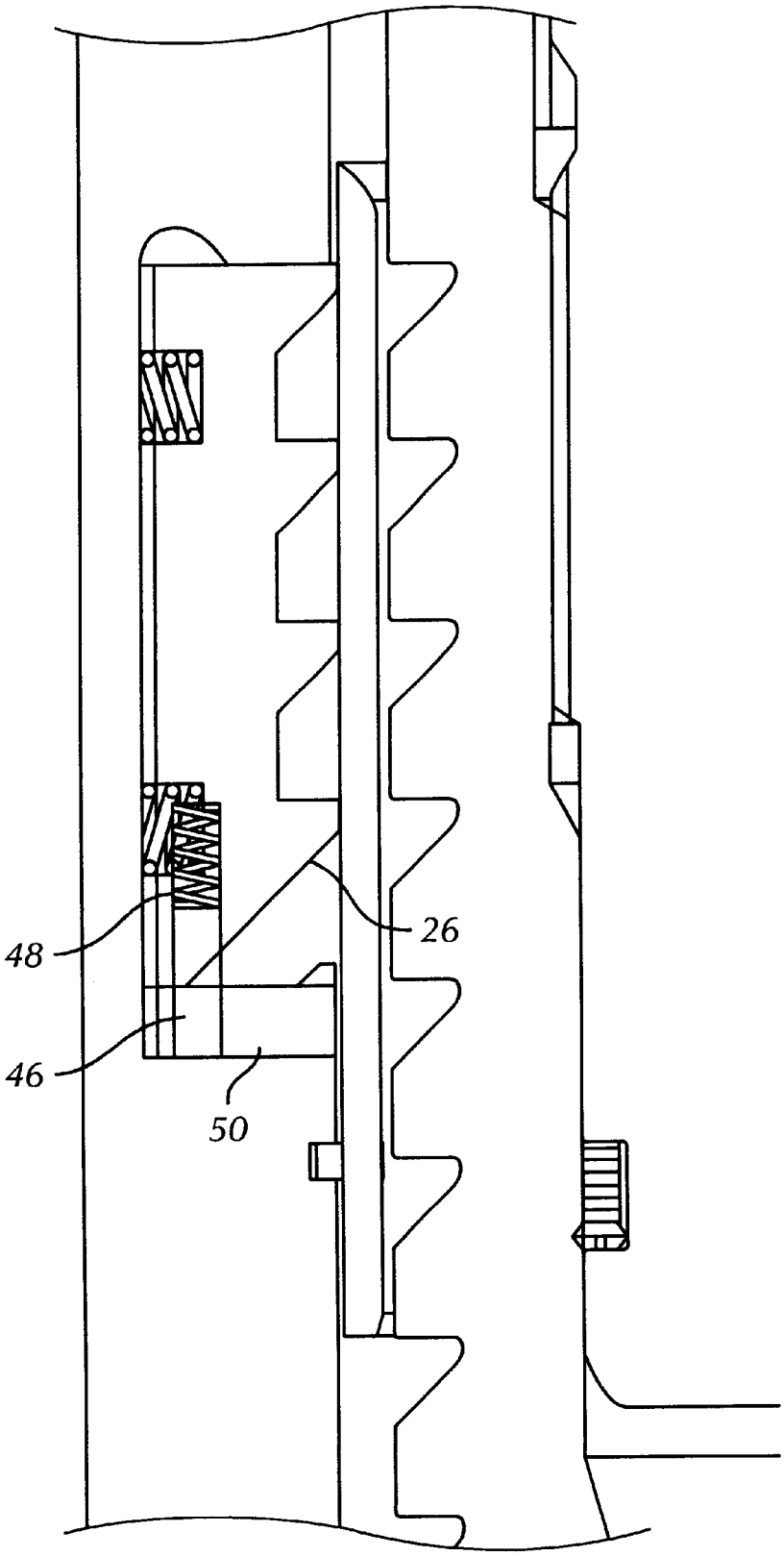
FIG. 3 is a detailed view of the pin of the locking mechanism.

A locking mechanism, which is made of a pin 46 and a locking spring 48 to orient the latching segment in the housing assembly of the inner barrel. The pin 46 is shown in FIG. 3 as a retaining pin that additionally has a groove 50 for holding the latching segment within the housing assembly.

Figure 4:
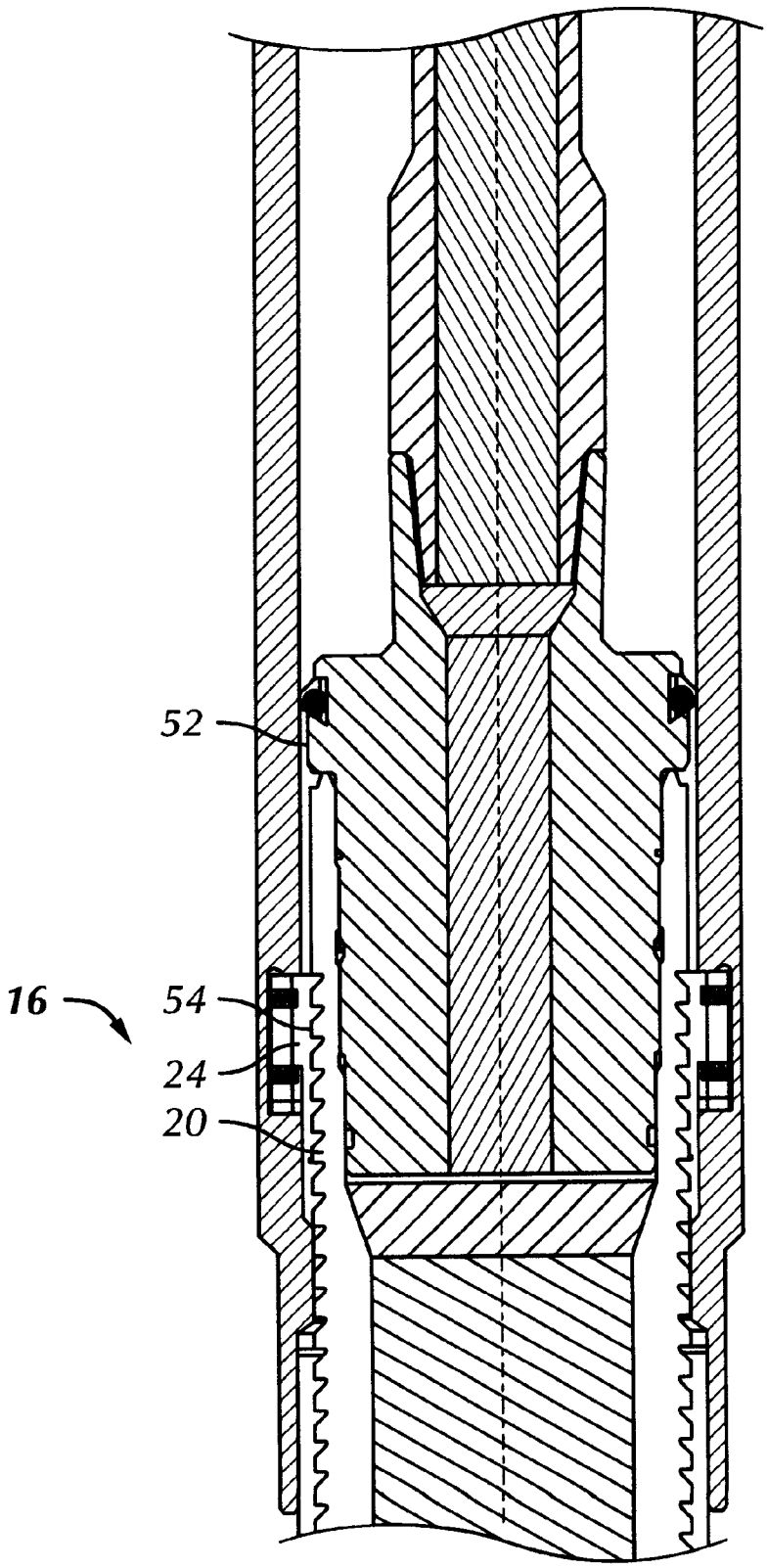
FIG. 4 shows a view of a wellhead using the invention and a running tool.

FIG. 4 shows a running tool 52 usable with the tension latching system 16 that has an tension adjusting feature 54 which enables the adjustable inner barrel 20 to be adjusted to tolerances within ½ inch. This tension adjusting feature is designed so that the latching segment 24 can be ratched until the correct tension is achieved on the adjustable inner barrel 20. When the correct tension adjustment has been achieved, the running tool is retrieved, and replaced with a pack off assembly.

In a preferred embodiment, the pack off assembly has a stab (100) in quick connect and disconnect for engaging and disengaging the inner barrel. The stab (100) is shown in FIG. 4.

In one embodiment, it is contemplated that the pack off seals 58 of the pack off assembly 56 are metal to metal seals. In another embodiment, it is contemplated that he pack off seals of the pack off assembly are elastomeric seals.

It is also contemplated that the wellhead has either a single string or dual string tubing hanger as part of the inventive subsea wellhead 8.

It should be noted that FIG. 1 shows: Casing hanger housing 14 is connected to a casing head 66. Casing head 66 also connects to tubing spool 26.

Casing head 66 further connects to stem head 70, which also connects to the outer riser 72.

Energizable seals 74 can be used to seal the inner diameter of casing hanger housing 14. O-rings 76 can be used on the outer diameter of casing hanger housing 14 to provide a sealing engagement and a fluid barrier between the casing hanger housing 14 and the stem head 70.

Outer riser 72 is also connected to tubing spool 26. Tubing spool 26 connectably engages adjustable inner barrel 20.

After the casing hanger housing 14 is landed on the well 8, adjustable inner barrel 20 is secured to the housing 22, which is preferably between a 16¾ inch and a 5½ inch diameter casing.

The adjustable inner barrel 20 with the associated annulus as 62 is shown in FIG. 1. Pack off sleeve 64 connected to casing hanger housing 14 is shown in FIG. 1.

The latching segments 24 can be pre-assembled with the casing hanger housing 14. Additionally a feature of the invention is that the adjustable inner barrel 20 can be adjusted upwardly as needed without cutting.

A running tool 52 is inserted into the adjustable inner barrel 20 downwardly so as to engage the adjustable inner barrel 20.

Another part of the invention, the pack off seals 58 are shown in FIG. 2. The pack off seals 58 are used to provide sealing engagement between pack off assembly 56 and the adjustable inner barrel 20 and adjustable inner barrel 20. Typical seals that are contemplated as usable in this invention include elastomeric seals, O-rings and even metal-to-metal seals to form this sealing engagement.

The design of the invention facilitates the installation and use of at least one but preferably, multiple continuous control lines, up to 9 control lines simultaneously. This is a significant feature and benefit of this invention.

The invention can be used with a stab in connection or a threaded connection. In an alternative embodiment of the invention, a quick disconnect is contemplated as a possible addition to the tension latching system.

If the tension latching system is used for a casion vessel, the size of the adjustable inner barrel 20 can vary from between five and ten feet. However, it is contemplated that the adjustable inner barrel 20 dimensions can be modified to accommodate different user needs, different types of platforms, and hence be a wide variety of lengths and diameters.

In the most preferred casion vessel embodiment, it is contemplated that the adjustable inner barrel 20 will feature a stab-in type coupler, which will eliminate the requirement of rotational engagement of the adjustable inner barrel 20, eliminating a difficult sealing problem. The adjustable inner barrel 20 can have a variety of profiles.

The tension parameters for the novel latching system are contemplated to enable engagement and latching with the inner barrel 20 at a force of up to 2 million pounds.

In an alternative embodiment, the latching segments 24 are preassembled "off platform" and installed and retained within the inner barrel housing with a profile prior to subsea installation.

The invention contemplates a method for latching a casing hanger for a subsea wellhead having an inner barrel and a housing assembly for an inner barrel, comprising the steps of: assembling a running tool with a pack off assembly on the running tool, wherein the pack off assembly has a split ring latching mechanism and a locking mechanism comprising a pin and a spring; a stab in to the inner barrel engaging the split ring latching mechanism, locking the pack off assembly to the inner barrel; pulling up on the running tool, forming tension on the running tool; adjusting the tension on the inner barrel to a predetermined amount of tension by ratching the latching segments against the inner barrel until the latching segment engages and locks the inner barrel in place; and removing the running tool from the pack off assembly. This method can also be used for tubing hangers.

Various embodiments may be made of the invention without departing from the scope of the description. It is to be understood that the details set forth in the text or shown in the accompanying drawings are to be given the broadest interpretation of the invention, and are only to be construed as illustrative and not limiting as to the invention.

What is claimed is:

1. A tension latching system for a hanger having an inner barrel and a housing assembly for an inner barrel, further comprising:

(a) latching segment contained within the inner barrel, wherein said latching segment further comprises a profile with a first side for engaging the inner barrel with latching teeth and a second side abutting the housing of the inner barrel;

(b) an adjustable inner barrel connecting to the latching segment, having an inner surface and an outer surface, and further comprising inner barrel teeth disposed on the outer surface and said latching teeth engaging said inner barrel teeth in an interlocking engagement;

(c) at least one spring for energizing the latching segment against the adjustable inner barrel;

(d) a locking mechanism comprising a pin and a locking spring to orient the latching segment in the housing assembly of the inner barrel;

(e) a running tool having a tension adjusting feature which enables the inner barrel to be adjusted to tolerances within ½ inch which further consists of a pack off assembly with pack off seals adapted to ratchet the latching segment until the correct tension is achieved on the adjustable inner barrel.

2. The apparatus of claim 1, wherein the hanger is a casing hanger.

3. The apparatus of claim 1 wherein the hanger is a tubing hanger.

4. The apparatus of claim 1, wherein said pin is a retaining pin that additionally has a groove for holding the latching segment within the housing assembly.

5. The apparatus of claim 1, wherein said running tool has a stab in quick disconnect for engaging the inner barrel.

6. The apparatus of claim 1 wherein the pack off seals of the pack off assembly are metal to metal seals.

7. The apparatus of claim 1, wherein the pack off seals of the pack off assembly are elastomeric seals.

8. The apparatus of claim 1, wherein said at least one spring comprises two springs, a small spring and a large spring.

9. The apparatus of claim 1, wherein said at least one spring is capable of enough spring force to engage the latching segment into the adjustable inner barrel.

10. A method for latching a casing hanger for a wellhead having an inner barrel and a housing assembly for an inner barrel, comprising the steps of:

(a) assembling a running tool with a pack off assembly on the running tool, wherein said pack off assembly has a split ring latching mechanism and a locking mechanism comprising a pin and a spring;

(b) stab into the inner barrel engaging the split ring latching mechanism, locking the pack off assembly to the inner barrel;

(c) pulling up on the running tool, forming tension on the running tool;

(d) adjusting the tension on the inner barrel to a predetermined amount of tension by ratching the latching segments against the inner barrel until the latching segment engages and locks the inner barrel in place; and (e) removing the running tool from the pack off assembly.

11. The method of claim 10, wherein the adjusting of the tension of the inner barrel occurs below the wellhead and in the housing assembly for the inner barrel.

12. The method of claim 10, wherein the stab in pack off assembly is a quick connect.

13. The method of claim 10, wherein the pack off assembly utilizes seals.

14. The method of claim 13, wherein the seals are metal to metal seals.

15. The method of claim 13, wherein the seals are elastomeric seals.

16. The method of claim 13, wherein the wellhead is a subsea wellhead.

17. A wellhead having a casing hanger with an inner barrel and a housing assembly for said inner barrel, further comprising a tension latching mechanism comprising:

(a) latching segment contained within the inner barrel, wherein said latching segment further comprises a profile with a first side for engaging the inner barrel with latching teeth and a second side abutting the housing of the inner barrel;

(b) an adjustable inner barrel connecting to the latching segment, having an inner surface and an outer surface, and further comprising inner barrel teeth disposed on the outer surface and said latching teeth engaging said inner barrel teeth in an interlocking engagement;

(c) at least one spring for energizing the latching segment against the adjustable inner barrel;

(d) a locking mechanism comprising a pin and a spring to orient the latching segment in the housing assembly of the inner barrel; and (e) a running tool having a tension adjusting feature which enables the inner barrel to be adjusted to tolerances within ½ inch which further consists of a pack off assembly with pack off seals adapted to ratchet the latching segment until the correct tension is achieved on the adjustable inner barrel.

18. The wellhead of claim 17, wherein the wellhead comprises a single string or dual string tubing hanger.

19. The wellhead of claim 17, wherein the wellhead is a subsea wellhead.

* * * * *